US010870993B2

(12) United States Patent
Steffes et al.

(10) Patent No.: US 10,870,993 B2
(45) Date of Patent: Dec. 22, 2020

(54) INDIVIDUAL POLYMER MASONRY PANELS, AND METHODS OF MANUFACTURE AND INSTALLATION

(71) Applicant: CertainTeed LLC, Malvern, PA (US)

(72) Inventors: Stephen W. Steffes, McPherson, TX (US); Brian W. Kirn, Hatboro, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/365,358

(22) Filed: Mar. 26, 2019

(65) Prior Publication Data

US 2019/0301178 A1 Oct. 3, 2019

Related U.S. Application Data

(60) Provisional application No. 62/650,418, filed on Mar. 30, 2018.

(51) Int. Cl.
*E04F 13/18* (2006.01)
*E04F 13/073* (2006.01)
*E04F 13/08* (2006.01)

(52) U.S. Cl.
CPC ..... *E04F 13/185* (2013.01); *E04F 13/0733* (2013.01); *E04F 13/0894* (2013.01)

(58) Field of Classification Search
CPC .. E04F 13/185; E04F 13/0733; E04F 13/0894
See application file for complete search history.

(56) References Cited

U.S. PATENT DOCUMENTS 569,002 A * 10/1896 Boehm ..... E06B 3/7001 52/316
3,217,453 A * 11/1965 Medow ..... E04F 13/185 52/314
3,518,799 A * 7/1970 Bachner ..... E04F 13/165 52/309.1
3,524,790 A * 8/1970 Mason ..... B44F 9/04 428/60
3,613,326 A * 10/1971 Mollman ..... E04F 13/0871 52/314
3,621,625 A * 11/1971 Medow ..... B44F 11/04 52/314
3,968,610 A * 7/1976 Medow ..... E04F 13/0871 52/314
4,522,002 A * 6/1985 Davis ..... E04F 13/185 52/309.1

(Continued)

*Primary Examiner* — Rodney Mintz
(74) *Attorney, Agent, or Firm* — McDonnell Boehnen Hulbert & Berghoff LLP

(57) ABSTRACT

The present disclosure relates generally to wall coverings or cladding, for example, suitable for covering and protecting the external surface of walls. The present disclosure relates more particularly to a system for a wall covering including first, second, and third polymer panels. Each of the polymer panels including a visible body extending from a respective support structure, where the visible body includes a front surface that extends across a width of the panel and has a textured contour that replicates a single masonry unit. The textured contours of the first, second, and third panels are different, and the size of the first panel is different from the size of the second panel.

20 Claims, 8 Drawing Sheets

(56) References Cited

U.S. PATENT DOCUMENTS 4,665,673 A * 5/1987 Diana ..... B28B 1/008 256/19
5,536,557 A 7/1996 Nasvik
5,992,116 A * 11/1999 Ternes ..... B29C 45/0005 52/518
6,237,294 B1 * 5/2001 Rygiel ..... B28B 7/007 264/220
6,808,667 B2 * 10/2004 Nasvik ..... B28B 7/36 249/102
7,368,152 B2 * 5/2008 Sakai ..... B29C 33/42 428/15
7,587,871 B2 * 9/2009 Perry ..... E04F 13/185 52/536
7,748,183 B2 * 7/2010 Myers ..... E04F 13/185 52/302.1
D622,419 S * 8/2010 King ..... D25/151
7,987,646 B2 * 8/2011 Race ..... B44C 5/0453 52/415
8,117,800 B2 * 2/2012 Lobson ..... B44C 5/04 52/288.1
8,151,530 B2 * 4/2012 Schwarz ..... E04F 13/0864 52/314
8,322,103 B1 * 12/2012 Kownacki ..... E04F 13/0733 52/235
D718,888 S * 12/2014 Schwarz ..... D25/151
8,950,135 B2 * 2/2015 Gaudreau ..... E04F 13/0733 52/288.1
9,027,302 B2 * 5/2015 Buoni ..... E04F 13/0837 52/311.1
9,388,565 B2 * 7/2016 Gaudreau ..... E04B 1/38
RE47,694 E * 11/2019 Buoni ..... E04F 13/0837
2003/0182888 A1 * 10/2003 Desbois ..... E04D 12/004 52/551
2005/0064128 A1 * 3/2005 Lane ..... B29C 44/1233 428/44
2006/0121247 A1 * 6/2006 Sakai ..... B29C 33/42 428/141
2006/0191228 A1 * 8/2006 Perry ..... E04F 13/185 52/506.01
2006/0197257 A1 * 9/2006 Burt ..... B29C 37/0032 264/255
2007/0056236 A1 * 3/2007 Lobson ..... B44C 5/04 52/311.1
2007/0137127 A1 * 6/2007 Lincoln ..... B44F 9/04 52/384
2007/0289247 A1 12/2007 Hamel
2008/0216446 A1 * 9/2008 Lobson ..... B44C 5/04 52/745.21
2009/0056257 A1 * 3/2009 Mollinger ..... B29C 37/0032 52/314
2009/0068406 A1 * 3/2009 Race ..... B44C 5/0453 428/156
2009/0117326 A1 * 5/2009 Hendricks ..... E04F 13/185 428/139
2009/0282764 A1 * 11/2009 Hendricks ..... E04F 13/185 52/311.1
2010/0192495 A1 8/2010 Huff
2010/0236175 A1 * 9/2010 King ..... B05B 13/0207 52/314
2011/0023396 A1 * 2/2011 Schwarz ..... E04F 13/0864 52/314
2014/0041331 A1 * 2/2014 Buoni ..... E04F 13/0837 52/506.01
2014/0165485 A1 * 6/2014 Gaudreau ..... E04F 13/0733 52/287.1
2014/0170365 A1 * 6/2014 Gavris ..... E04F 13/0876 428/71
2014/0174015 A1 * 6/2014 Gaudreau ..... E04B 1/38 52/588.1

* cited by examiner

INDIVIDUAL POLYMER MASONRY PANELS, AND METHODS OF MANUFACTURE AND INSTALLATION

CROSS-REFERENCE TO RELATED APPLICATIONS

This application claims the benefit of priority of U.S. Provisional Patent Application No. 62/650,418, filed Mar. 30, 2018, which is hereby incorporated herein by reference in its entirety.

BACKGROUND OF THE DISCLOSURE

1. Field of the Disclosure

The present disclosure relates generally to wall coverings or cladding, for example, suitable for covering and protecting the external surface of walls. The present disclosure relates more particularly to a polymer wall covering having the appearance of a masonry wall.

2. Technical Background

Housing façades that appear as masonry walls are popular. In some cases, the entire façade is masonry, and in other cases only a section of the façade, for example a lower portion, is masonry. Masonry is attractive and provides an impression of strength and stability. Stone masonry, in particular, is popular for portions of housing façades because it has a heavy stable appearance.

However, masonry is costly to install. The stones or bricks are laid individually and attached to the surrounding elements of the wall using mortar. Even veneers of thin masonry require attaching stone or brick to the wall substrate using mortar. Achieving a satisfactory appearance is difficult, and professional stone masons are often used to create the veneer, which is costly.

Large faux stone or brick panels made of polymer, which represent a group of stones or bricks, are easier to install. However, in certain instances these panels are easily distinguished from true masonry. The large panels have a distinct pattern of a group of stones, which identically repeats over the expanse of the wall. If a person observes the wall closely, they are likely to notice the pattern and then identify that the pattern repeats. As a result, even if the individual stones or bricks have a realistic appearance, the repeating pattern will reveal that the wall is not truly masonry.

The present inventors have recognized that a system having the appearance of a masonry wall, but that is both easier to install than true masonry and that avoids an identically repeating pattern would be advantageous and attractive to builders.

SUMMARY OF THE DISCLOSURE

In one aspect, the disclosure provides a system for a wall covering having an appearance of a masonry wall, the system comprising:

- a first polymer panel including a first visible body extending from a first support structure, the first visible body including a front surface that extends across a width of the first panel and has a first textured contour that replicates a single masonry unit;
- a second polymer panel including a second visible body extending from a second support structure, the second visible body including a front surface that extends across a width of the second panel and has a second textured contour that replicates a single masonry unit; and
- a third polymer panel including a third visible body extending from a third support structure, the third visible body including a front surface that extends across a width of the third panel and has a third textured contour that replicates a single masonry unit;
- wherein the first, second, and third textured contours are different, and
- wherein the size of the first panel is different from the size of the second panel.

In another aspect, the disclosure provides a polymer masonry wall covering comprising:

- a wall substrate; and
- a system for a wall covering attached to the wall substrate, the system including:
  - a first polymer panel including a first visible body extending from a first support structure, the first visible body including a front surface that extends across a width of the first panel and has a first textured contour that replicates a single masonry unit;
  - a second polymer panel including a second visible body extending from a second support structure, the second visible body including a front surface that extends across a width of the second panel and has a second textured contour that replicates a single masonry unit; and
  - a third polymer panel including a third visible body extending from a third support structure, the third visible body including a front surface that extends across a width of the third panel and has a third textured contour that replicates a single masonry unit;
  - wherein the first, second, and third textured contours are different, and
  - wherein the size of the first panel is different from the size of the second panel.

In another aspect, the disclosure provides a method of installing a polymer masonry wall covering comprising:

- providing a system according to the disclosure;
- providing a wall substrate; and
- attaching the panels of the system to the wall substrate.

In another aspect, the present disclosure provides a wall unit comprising:

- a frame including a plurality of openings; and
- the system of the disclosure, wherein a group of the panels of the system are received in the openings of the frame.

In yet another aspect, the disclosure provides a method of fabricating wall units comprising:

- providing the system according to the disclosure;
- providing a first frame including a plurality of openings;
- inserting a group of panels into the openings in the first frame so as to form a first wall unit, the group of panels including the first, second, and third panels.

In another aspect, the disclosure provides a method of installing a wall covering comprising:

- providing a plurality of wall units including a frame with a plurality of openings and a group of panels of the system of the disclosure received in the openings of the frame; and
- attaching the wall units to a substrate wall.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional masonry walls and masonry veneers are costly and difficult to install, and existing polymer based solutions are easily identifiable because of their repeating patterns. The present inventors have developed a system that is easy to install and can avoid a repeating pattern.

Figure 1:
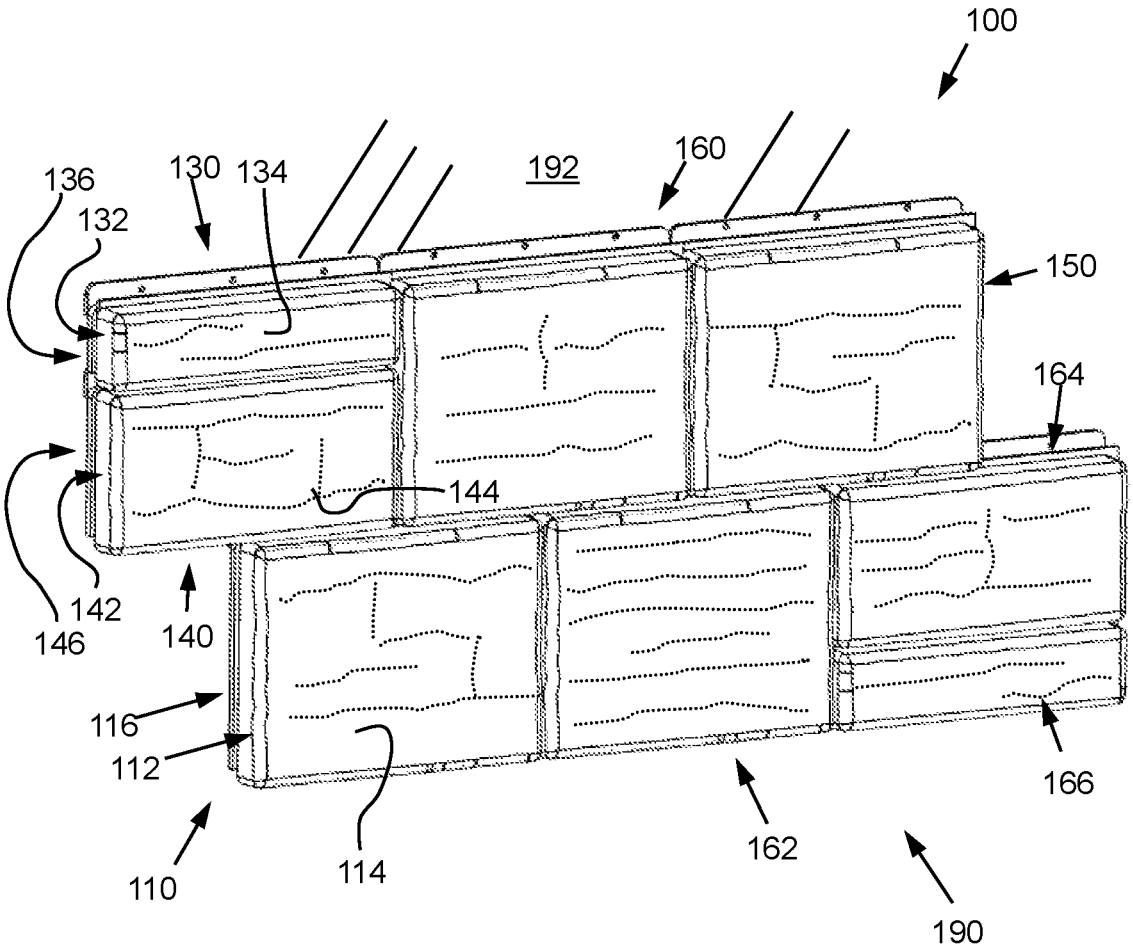
FIG. 1 is a schematic perspective view of a portion of a wall covering including a system according to an embodiment of the disclosure.
Figure 2:
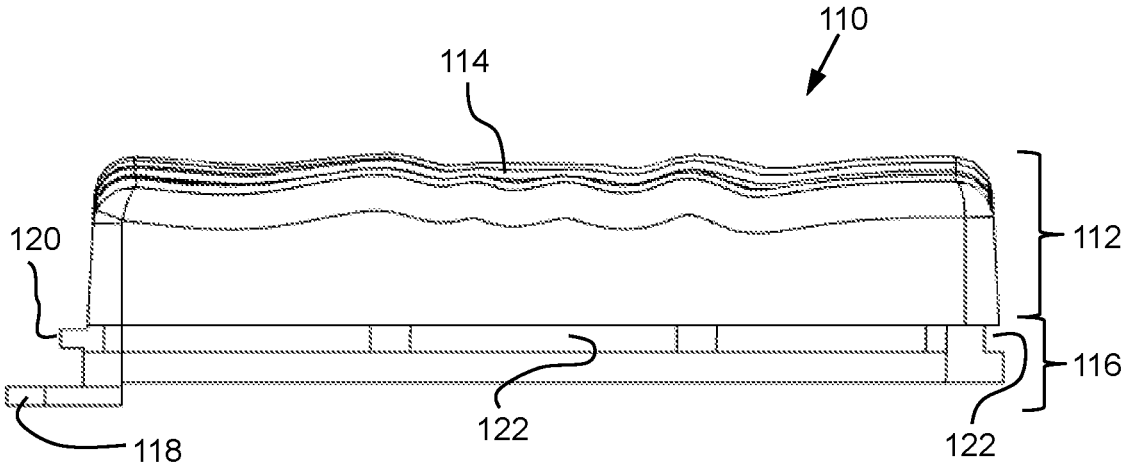
FIG. 2 is a schematic side view of a panel of the system of FIG. 1.
Figure 3:
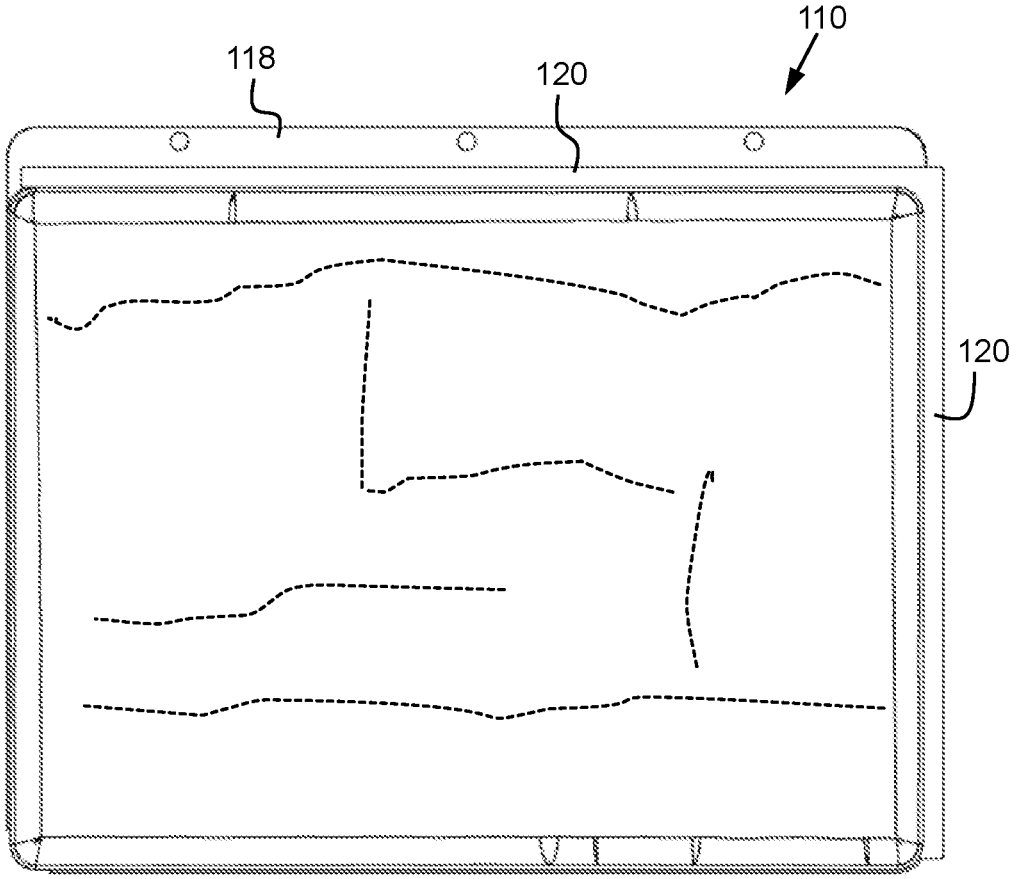
FIG. 3 is a schematic front view of the panel of FIG. 2.

Accordingly, one aspect of the disclosure is a system for a wall covering having an appearance of a masonry wall. The system comprises: a first polymer panel including a first visible body extending from a first support structure, the first visible body including a front surface that extends across a width of the first panel and has a first textured contour that replicates a single masonry unit; a second polymer panel including a second visible body extending from a second support structure, the second visible body including a front surface that extends across a width of the second panel and has a second textured contour that replicates a single masonry unit; and a third polymer panel including a third visible body extending from a third support structure, the third visible body including a front surface that extends across a width of the third panel and has a third textured contour that replicates a single masonry unit. The first, second, and third textured contours are different, and the size of the first panel is different from the size of the second panel. Such a system is shown in perspective view in FIG. 1, and a detailed view of a single panel of the system is shown in FIGS. 2 and 3. System 100 includes a plurality of panels 110, 130, 140, 150, 160, 162, 164, 166 for a wall covering having the appearance of a masonry wall.

System 100 includes a first panel 110 with a first visible body 112 that is attached to and extending outward from a first support structure 116. First visible body 112 includes a front surface 114 that extends across a width of first panel 110. Front surface 114 is opposite support structure 116 and is the most visible face of panel 110 when the panel is attached to a substrate surface. Front surface 114 includes a first textured contour that replicates a single masonry unit. System 100 also includes a second panel 130 with a second visible body 132 and a second support structure 136 as well as a third panel 140 with a third visible body 142 and a third support structure 146. Like the first panel 110, the second and third panels 130, 140 also include front surfaces 134, 144 that have respective second and third textured contours that each replicate a single masonry unit.

The respective front surfaces 114, 134, 144 of the first, second and third panels 110, 130, 140 each have a different textured contour. The term textured contour, as used herein, refers to the specific three dimensional shape of the front surface, including all of the peaks, pits, ridges, and valleys of the surface's contour. As explained in more detail below, the particular textured contour of each panel is based on a real masonry unit and replicates the surface of the real masonry unit. Thus, the first, second, and third panels 110, 130, and 140 are modeled after different masonry units, or at least different portions of a masonry unit.

The first, second, and third panels 110, 130, 140 are all different sizes. Accordingly, the front surfaces 114, 134, 144 of the panels are also different sizes and therefore the contours of the front surfaces are inherently different. However, two panels of the same size may also have different textured contours. For example, while first panel 110 and panel 164 are the same size and both have a generally rough front surface, the respective front surfaces of the two panels have different specific textured contours.

Figure 4:
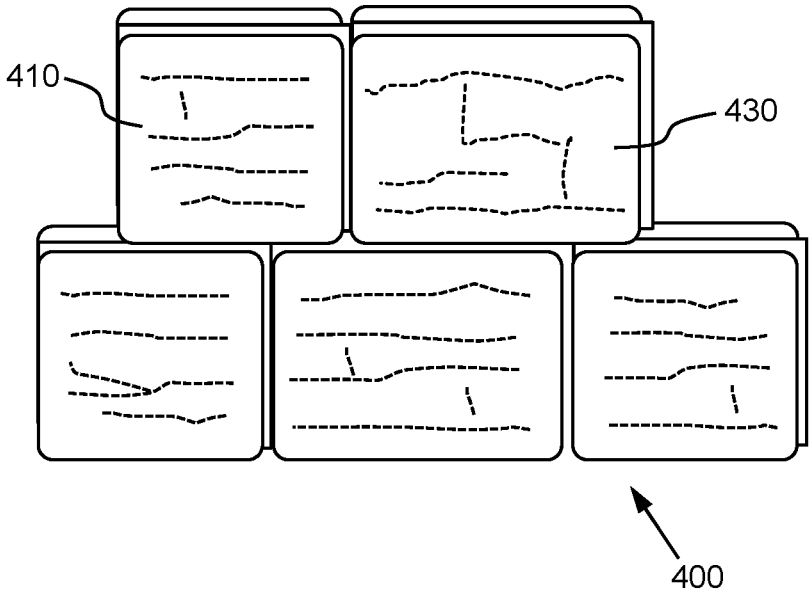
FIG. 4 is a schematic front view of a portion of a system according to another embodiment of the disclosure.

In certain embodiments as otherwise described herein, a height of the first panel is different from a height of the second panel. In other embodiments, the width of the first panel is different from the width of the second panel. For example, in system 100, the height of first panel 110 is greater than the height of second panel 130. In contrast, in system 400, shown in FIG. 4, the height of each of the panels is the same, but the width of the panels is different. Specifically, the width of first panel 410 is smaller than the width of second panel 430. In some embodiments, the respective panels of the system differ in both height and width.

In certain embodiments as otherwise described herein, the size of the third panel is different from the size of the first panel and the size of the second panel. For example, in system 100, third panel 140 has a different size than either first panel 110 or second panel 130 by virtue of its height. Specifically, third panel 140 is shorter than first panel 110 but taller than second panel 130. Indeed, the combined height of the second and third panels 130, 140 is equal to the height of the first panel 110.

In certain embodiments as otherwise described herein, the first, second, and third textured contours replicate split stone masonry units. The term split stone masonry units broadly refers to any stones that have been broken or worked to a desired shape and thereby have a textured contour that replicates a fractured surface of the stone. Thus, the term split stone encompasses most stone surfaces that are generally flat but have not been polished to a smooth surface. For example, the textured contours of the front surfaces of the panels of system 100 each replicate split stone masonry units.

Figure 5:
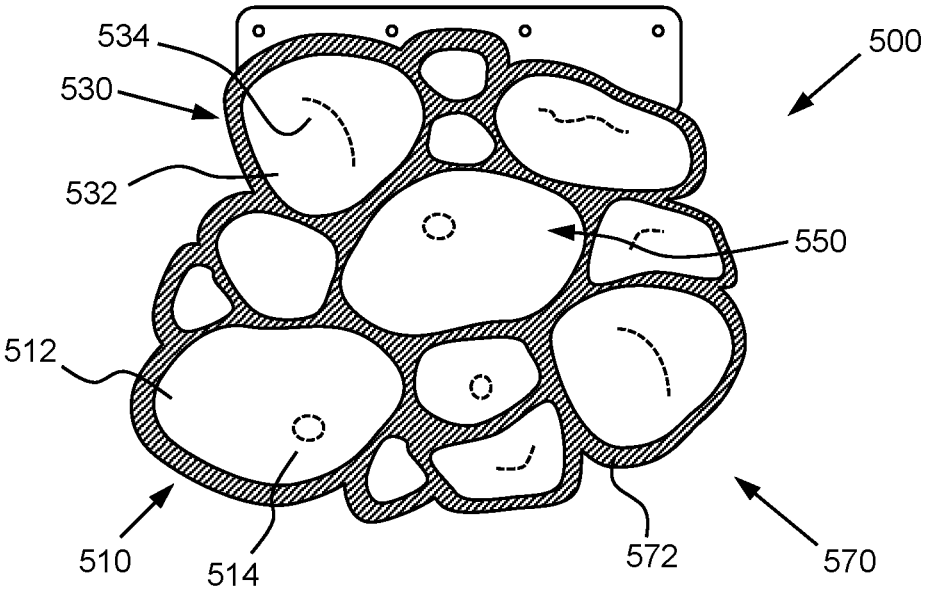
FIG. 5 is a schematic front view of a portion of a system according to yet another embodiment of the disclosure.
Figure 6:
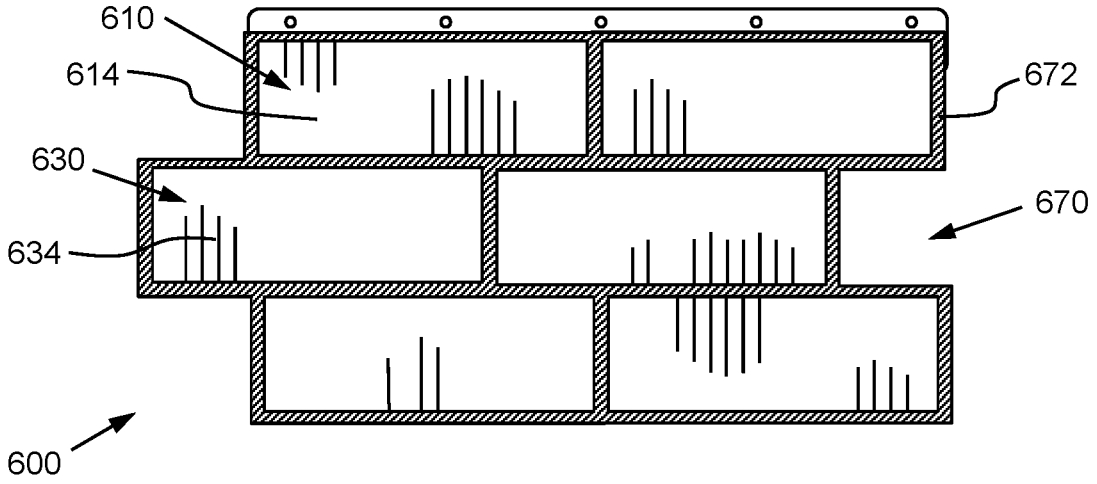
FIG. 6 is a schematic front view of a portion of a system according to still another embodiment of the disclosure.

In certain embodiments as otherwise described herein, the first, second, and third textured contours replicate smooth stone masonry units. Smooth stone masonry units include stones that have been polished as well as stones that have been naturally worn to a smooth surface, for example by water. In certain embodiments, the visible body of smooth stone masonry units that appear as though they have been naturally worn have a round periphery. For example, a system including panels with such textured contours is shown in FIG. 5. Specifically, the front surfaces 514, 534 of panels 510, 530 in system 500 replicate river rock and include rounded surfaces similar to surfaces that have been worn down by water. Further, the visible bodies 512, 532 of the panels have round peripheries. It may be noted that the panels of system 500 are included in a wall unit 502, which is explained in more detail below.

In certain embodiments as otherwise described herein, the first, second, and third textured contours replicate brick masonry units. For example, the front surfaces 614, 634 of the panels 610, 630 in system 600 replicate bricks. Like bricks, the visible bodies 612, 632 of the panels are rectangular.

In certain embodiments as otherwise described herein, each of the first, second, and third textured contours has a contour depth range that is no more than 2 cm (0.79 in.), e.g., no more than 1 cm (0.39 in.), e.g., no more than 0.5 cm (0.20 in). The term contour depth range, as used herein, refers to the difference in depth, with respect to a direction perpendicular to the front surface of a panel, between the lowest valley and the highest peak across the front surface of a respective panel.

As set forth above, the textured contour of the front surface of the visible body extends across the width of the panel. Further, the textured contour replicates a single masonry unit. Thus, for example in system 100, the various panels each replicate a single masonry unit of the completed covered wall assembly. The panels 110, 130, 140 are each separate constructions and have only a single visible body with one front face that replicates a single masonry unit. Accordingly, while portions of a respective panel, such as the support structure, may extend beyond the edges of the front surface of the visible body, the textured contour extends across a majority of the panel to replicate a single masonry unit. In certain embodiments, each of the first, second, and third textured contours extend across at least 80% of the width of the respective panel, e.g., at least 90%, e.g., at least 95%.

Because the textured contours of the panels replicate a single masonry unit, they are free of any contour elements that represent divisions between separate stones or bricks. For example, the textured contours are free of any grout lines. Thus, in certain embodiments as otherwise described herein, each of the textured contours is free of any straight channels of more than 1 inch in length. Such a straight channel, if included, might indicate a grout line or other division between masonry units. The term "straight channel" as used herein refers to a channel that runs in a straight light and has a constant cross section. For example, a channel in the shape of a hemisphere that runs between two portions of a panel might represent a division between two masonry units. In certain embodiments, the panels of the system include front faces with textured contours that are free of any such channels that are greater than 1 inch in length.

As set forth above, the visible body of the panels extends from a support structure. As explained above, the visible body includes a front surface having a textured contour that replicates a single masonry unit. Further, the support structure is configured to hold the panel to a larger structural unit, such as the surface of a substrate wall or to a frame as described in more detail below. In certain embodiments as otherwise described herein, the visible bodies of the panels are hollow and have a front wall including the front surface, as well as a perimeter wall. In cooperation with visible bodies of this configuration, in certain embodiments, the support structure is in the form of a wall that extends around the perimeter of the panel and is attached to the perimeter wall of the visible body. In other embodiments the visible body is solid. Likewise, in some embodiments the support structure is a platform that extends across the panel. Other combinations of the support structure and visible body configuration are also possible, as will be appreciated by those of ordinary skill in the art.

In certain embodiments as otherwise described herein, the support structure of each of the panels includes a fastening hem disposed on a first side of the panel and configured hold the panel on a substrate. For example, as shown in detail in FIGS. 2 and 3, support structure 116 of panel 110 includes fastening hem 118. The fastening hem 118 is a thin flange that runs across the top of the panel and allows the panel to be attached to a substrate using a mechanical fastener, such as a screw, nail, or staple. Fastening hem 118 includes apertures to receive the mechanical fasteners. In other embodiments, such apertures are excluded.

Figure 7:
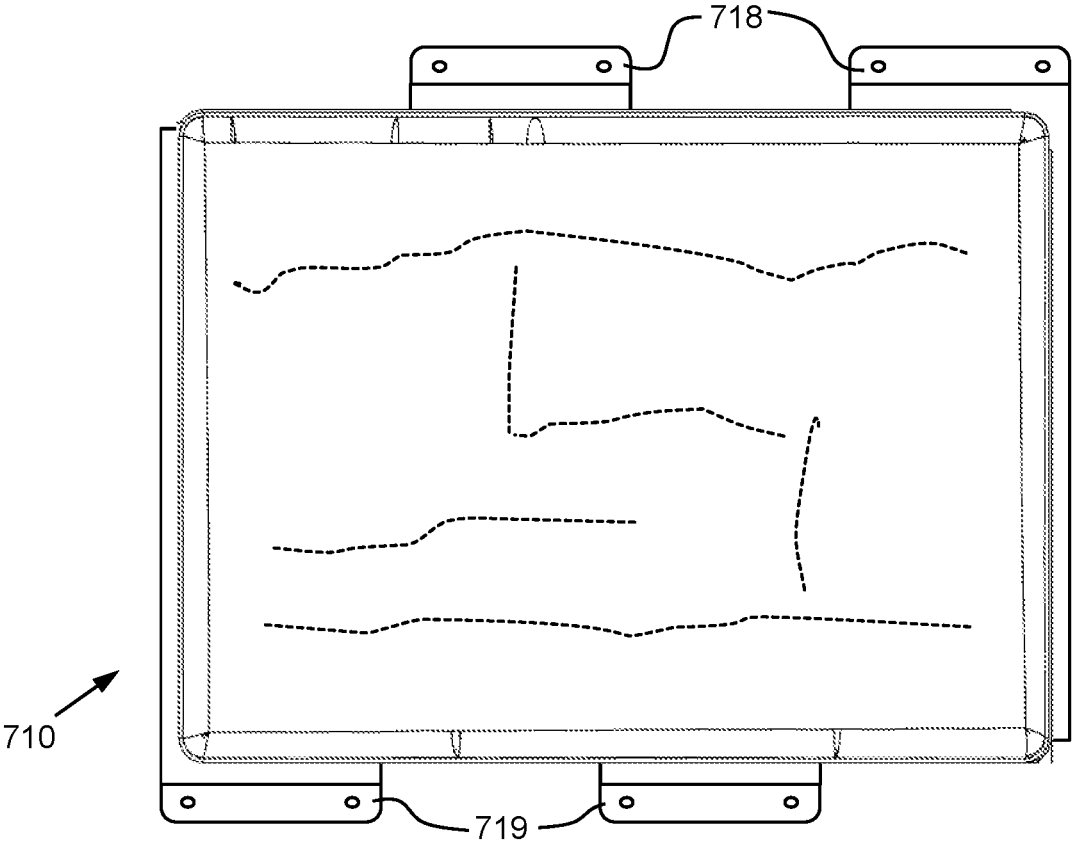
FIG. 7 is a schematic front view of a panel according to an embodiment of the disclosure.

In certain embodiments as otherwise described herein, the support structure of at least the first panel includes a second fastening hem disposed on a second side of the panel. For example, panel 710 shown in FIG. 7 includes fastening hems 718 and 719 on opposing upper and lower sides of the panel. This configuration allows panel 710 to be easily installed in two orientations using the respective fastening hems. For example, panel 710 can be hung from fastening hem 718 on one side of the panel, or the panel can be rotated 180 degrees and hung from the fastening hem 719 on the other side of the panel. Each of fastening hems 718 and 719 include two sections. The sectioned configuration of fastening hems 718 and 719 provides adequate gaps within the fastening hem allowing the panels to cooperate with neighboring panels without interfering with one another. For example the sections of the fastening hem at the top of one panel may rest in the gaps between fastening hems at the bottom of an adjacent panel.

Embodiments of the disclosure include panels having a wide range of sizes. For example, in certain embodiments as otherwise described herein, the visible body of each of the panels has a height in a range of 1 to 10 inches, e.g., 2 to 8 inches, e.g., 4 to 6 inches. For example, in one embodiment the system includes panels having heights of 3 inches and 6 inches, both falling within the range of 2 to 8 inches. Likewise, in some, the visible body of each of the panels has a width in a range of 3 to 15 inches, e.g., 4 to 12 inches, e.g., 6 to 10 inches. Further, in certain embodiments as otherwise described herein, the visible body of each of the panels has a depth in a range of ½ inch to 4 inches, e.g., 1 to 3 inches, e.g., 2 to 3 inches.

In certain embodiments as otherwise described herein, each of the panels is formed of one or more of polypropylene, polyethylene, polyvinyl chloride (PVC), acrylonitrile styrene acrylate (ASA), polyurethane, or acrylonitrile butadiene styrene (ABS). Further, while the system includes polymer panels, in that the structure and shape of the panel is associated with a polymer construction, the panels can include a large percentage of filler. For example, a panel formed with a polyurethane matrix may include a majority of filler (such as fly ash) and still be considered a "polymer panel," as will be appreciated by those of ordinary skill in the art. Likewise, the polymer panels may include small sections that are made from another material, such as a metal. For example in some embodiments the fastening hem may include metal parts for stability.

In certain embodiments as otherwise described herein, each of the panels includes a coating disposed over at least the front surface of the visible body. In some embodiments, the coating blocks ultraviolet (UV) light to protect the body of the panel from UV degradation. In some embodiments, the coating is decorative and imparts a particular visual aspect to the panel. For example, in some embodiments the coating is opaque and has a particular color. In other embodiments, the coating is transparent. In some embodiments, the coating is variegated, such that different portions of the surface of the panel have different colors. For example, in some embodiments, the coating is partially transparent such that sections of the underlying material of the visible body show through the coating while other sections are overlaid with an opaque covering. In some embodiments the coating includes an image of a natural product. In some embodiments, the coating provides a texture to the surface of the panel, for example to provide a desired tactile sensation when the panel is touched.

In certain embodiments, the coating is applied directly to the outer surface of the panels. In other embodiments, the coating is applied to the surface of a mold and is secured to the material of the panel during the molding process. In some embodiments, the coating is provided as a liquid that is sprayed or otherwise applied onto the body of the panel or into the mold. In other embodiments the coating is a film or laminate that is stretched over or otherwise applied to the panel body. Still, in other embodiments the film or laminate coating is inserted into a mold before the molding process.

In certain embodiments as otherwise described herein, each of the panels is injection molded. In some embodiments, the panels are injection molded in groups, which are then separated into individual panels. In other embodiments, each of the panels is rotomolded, thermoformed, or cast. For example, in some embodiments the panels are formed of polyethylene and roto-molded. In some embodiments the panels are fabricated through an additive process. For example, in some embodiments the panels are made by 3D printing.

In certain embodiments as otherwise described herein, each of the first, second, and third textured contours is a digitized rendering of a stone. For example, in some embodiments a natural stone is scanned using either a laser scanner or a white light scanner to form a digital 3D rendering of the stone. A mold is then fabricated using the digital rendering and the panels are produced with the digitized rendering of the stone from the mold. In other embodiments, digital rendering of the stone is used by a 3D printer to create the panels. Still in other embodiments, a cast is made from the naturally occurring stone, and a mold is subsequently made based on the cast.

In certain embodiments as otherwise described herein, the colors of the panels of the system are very similar in order to provide uniformity throughout the wall covering. For example, in some embodiments the color difference between one panel and any neighboring panels is no more than 2 ΔE based on the Hunter Lab color scale. In other embodiments the difference in color between the panels is more pronounced. In certain embodiments this difference in color can provide a more natural aesthetic. For example, river rock often varies in color from one stone to the next. In some embodiments, this color variation is provided by a surface coating, such as a paint, on the visible body. In other embodiments, the color of the material of the panels is varied from one panel to the next. For example, in certain embodiments, a color of the material of the first panel and a color of the material of the second panel have a color difference of at least 2 ΔE, e.g., at least 4 ΔE, e.g., at least 10 ΔE. In some embodiments, the color difference between a panel of the system and at least three neighboring panels of the system is at least 2 ΔE, e.g., at least 4 ΔE, e.g., at least 10 ΔE.

In certain embodiments as otherwise described herein, the support structure of each of the panels includes a tongue extending along a first edge and a receiving groove extending along a second edge that is opposite the first edge. For example, panel 110 includes a tongue and groove structure 120, 122 around its perimeter. In particular, the top edge of the support structure 116 of panel 110 includes a tongue 120 and the bottom edge includes a groove 122 for receiving a corresponding tongue of a neighboring panel. Tongue 120 also extends to the right side of support structure 116 and groove 122 extends to the left side. Accordingly, the panels can couple with both upper and lower neighboring panels as well as laterally neighboring panels. In some embodiments, the panels include a tongue and groove structure only on two opposing sides. Likewise, other embodiments include additional or alternative features for interlocking the panels, as will be appreciated by those of ordinary skill in the art.

Figure 8:
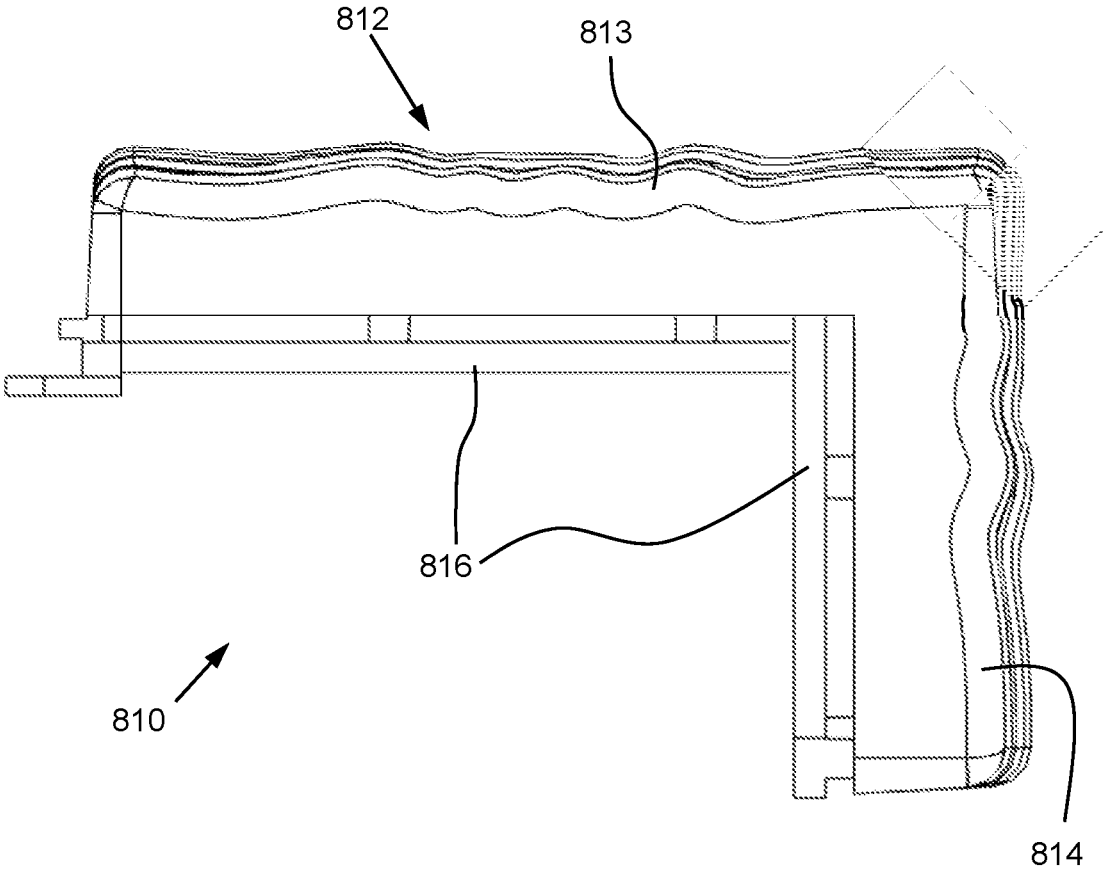
FIG. 8 is a schematic top view of a panel according to another embodiment of the disclosure.

In certain embodiments as otherwise described herein, the system further includes a corner polymer panel including a visible body extending from an L-shaped support structure, the visible body including a dual-faceted surface that extends across a width and a breadth of the corner panel and has a textured contour that replicates two sides of a single masonry unit. For example, panel 810, shown in FIG. 8, includes an L-shaped support structure 816 and a similarly L-shaped visible body 812. The visible body includes a dual-faceted surface with a continuous textured contour. In particular, visible body 812 includes a first contoured section 813 and a second contoured section 814. The corner panel is particularly configured to cover the outer corner of a wall. In some embodiments, the system includes an inner corner panel with a similar configuration configured to cover an inner corner of two adjoining walls.

Another aspect of the disclosure provides polymer masonry wall covering comprising: a wall substrate; and a system of panels according to any of the embodiments described above attached to the wall substrate. A portion of such a wall covering is shown, for example, in FIG. 1. Wall covering 190 includes system 100 including a number of panels 110, 130, 140, 150, 160, 162, 164 and 166 attached to wall substrate 192. In some embodiments the wall substrate is an exterior sheathing. As will be understood by those of ordinary skill in the art, such an exterior sheathing can include a rain protection layer, house wrap, and/or may include furring strips. In other embodiments, the wall substrate is another flat structural component of a construction wall.

In certain embodiments as otherwise described herein, the wall covering includes a plurality of different panel types attached to the wall substrate, each of the panel types including a front face having a different textured contour. The term panel type as used herein refers to the three dimensional configuration of the panel, both with respect to size and with respect to the textured contour of the front face. For example, panels made from the same mold are the same panel type. Thus, in some embodiments two panels of the same panel type are substantially identical, except they may differ in color. The portion of a wall covering 190 shown in FIG. 1 includes 8 different panels of 6 different panel types. The first, second, and third panels 110, 130, 140 are all of different types, and differ both in size and textured contour. Panels 160 and 162 are the same size as first panel 110, but have different textured contours, and thus are each of different panel types as well. Likewise panel 164 is the same size as third panel 140 but has a different textured contour and thus is a different panel type. However, fourth panel 150 is of the same type as first panel 110, having similar size and textured contours as one another. Likewise, panel 166 is the same panel type as second panel 130.

In certain embodiments as otherwise described herein, the first panel is of a first panel type, the wall includes a fourth panel of the first panel type, and the first and fourth panels are disposed at respective orientations that are 180 degrees from one another. For example, as stated above, fourth panel 150 is of the same type as first panel 110. However, fourth panel 150 is oriented at 180 degrees from wall panel 110. In other words, the edge of the panel that is used as the bottom in first panel 110 is used as the top edge in fourth panel 150, and vice versa.

The ability to place the individual panels in any configuration, to rotate the panels, and to vary the color of the panels makes it possible, in some embodiments, to create a wall covering without any discernible repetition using panels of only a few different sizes. In certain embodiments as otherwise described herein, the polymer masonry wall includes panel types of no more than 8 different sizes, e.g., no more than 6 different sizes, e.g., no more than 4 different sizes, e.g., no more than 3 different sizes.

Likewise, the range of possible different configurations also allows many patterns without the need for a large number of panel types for each size. For example, in certain embodiments as otherwise described herein, the polymer masonry wall includes no more than 8 different panel types of a particular size. Indeed, the overall number of panel types can be small and still form wall coverings having a very large variety of different configurations. In certain embodiments as otherwise described herein, the polymer masonry wall includes no more than 16 different panel types, e.g., no more than 10 different panel types, e.g., no more than 8 different panel types.

In certain embodiments as otherwise described herein, each of the panels is attached to the wall substrate using a mechanical fastener. For example, the panels are attached to the wall substrate using screws, nails, or staples, as described in more detail below. Other fasteners for attaching the panels to the substrate are also possible, as will be appreciated by those of ordinary skill in the art.

In certain embodiments as otherwise described herein, each of the panels is attached to the wall substrate along an upper edge, but detached from the wall substrate along a lower edge. Thus, installation of the panels against the substrate wall can be fast and convenient. Further, the support structures of the panels can include complementary features to hold the neighboring panels securely in place. For example, the tongue and groove structure of panel 110 allows each panel to be attached to the substrate along only one edge, but to form an interlocking structure that is held firmly against the substrate.

Another aspect of the disclosure provides a method of installing a polymer masonry wall covering that includes providing a system according to any of the above embodiments, providing a wall substrate, and attaching the panels of the system to the wall substrate.

In certain embodiments as otherwise described herein, each of the panels includes a fastening hem, and wherein the attaching of the panels to the wall substrate includes fastening each of the panels to the wall substrate using a mechanical fastener that penetrates the fastening hem. For example, the panels in system 100 include fastening hems (shown in detail in FIGS. 2 and 3), that are used to attach the panels to substrate 192. A mechanical fastener, such as a screw, nail, staple or other fastener is inserted through the fastening hem to hold the panel against the substrate. In some embodiments, the fastening hem includes apertures for the insertion of the mechanical fastener. For example the panels in system 100 include screw holes in the respective fastening hems.

In certain embodiments as otherwise described herein, the act of attaching the panels includes fastening each of the panels along an upper edge, and leaving a lower edge of each of the panels detached from the wall substrate, and wherein the lower edge of a majority of the panels is held against the wall substrate by a neighboring panel. For example, as explained above, a cooperative structure of the panels can result in an interlocking system between the panels, such as the tongue and groove structure of system 100. This cooperative structure securely holds the entirety of each panel against the substrate while only fastening one edge of the panel directly to the substrate.

In certain embodiments as otherwise described herein, the panels include a plurality of different panel types, each of the panel types including a front face having a different textured contour, wherein the first panel is of a first panel type, and wherein the attaching the panels to the wall substrate includes attaching a fourth panel, that is of the first panel type, to the wall substrate in an orientation that is 180 degrees from the orientation of the first panel. For example, as explained above with respect to system 100, fourth panel 150 is of the same panel type as first panel 110. When attaching panel 150 to the wall substrate, the panel is rotated to have an orientation that is inverted, i.e., rotated 180 degrees, with respect to the first panel. Attaching the fourth panel 150 in this orientation varies the configuration of panels against the substrate without the need for an additional panel type.

Figure 9:
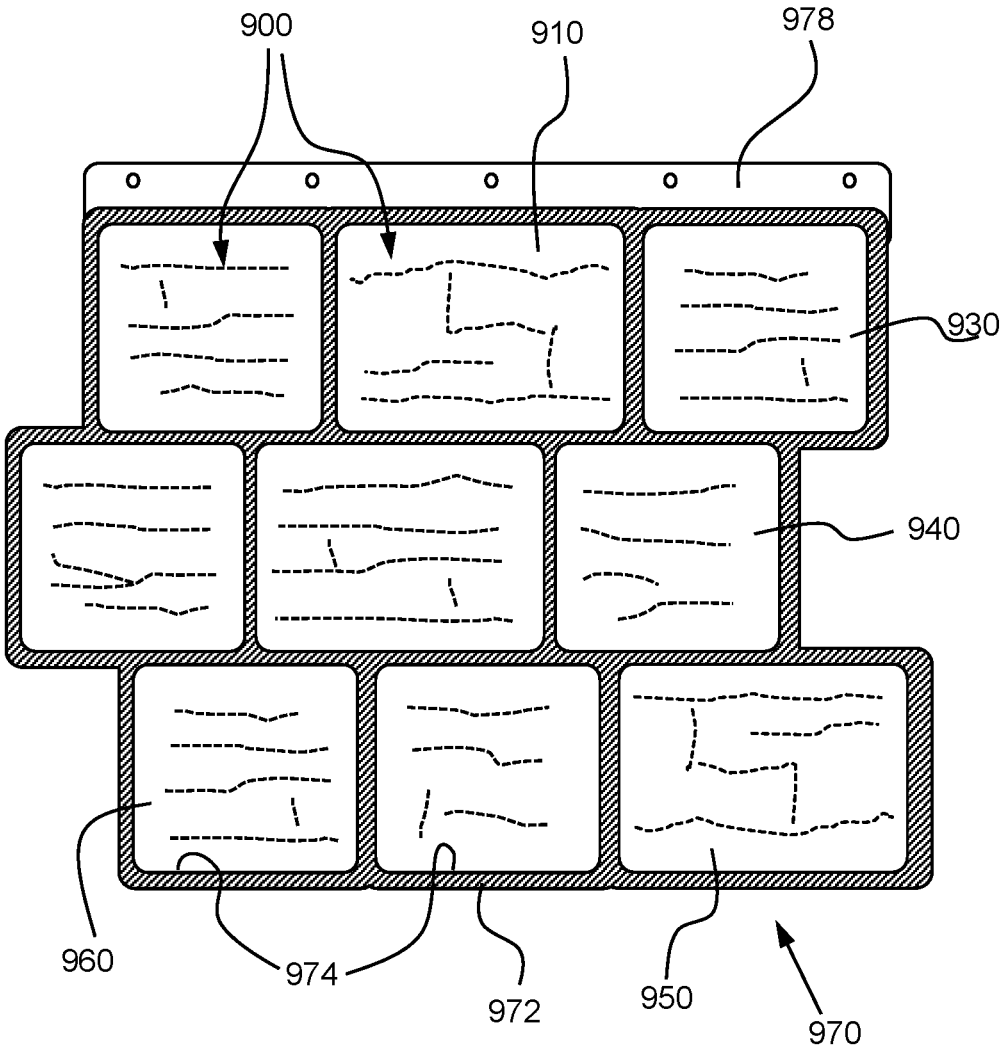
FIG. 9 is a schematic front view of a wall unit according to an embodiment of the disclosure.
Figure 10:
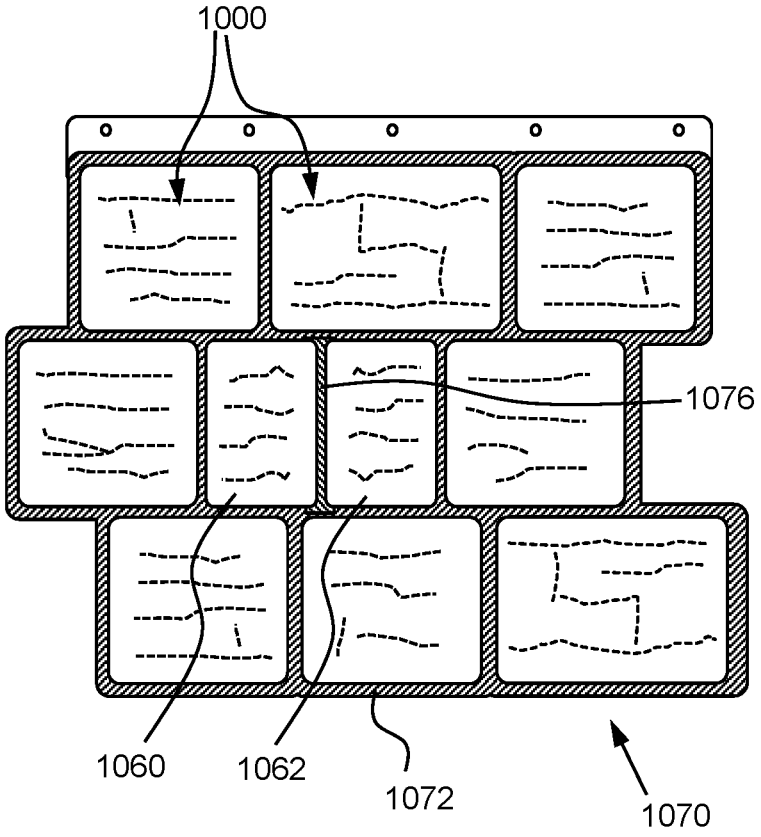
FIG. 10 is a schematic front view of a wall unit according to another embodiment of the disclosure.

Another aspect of the disclosure provides a wall unit including a frame having a plurality of openings and the system of panels of the disclosure, wherein the first, second, and third panels are received in the openings of the frame. Such a wall unit is shown in FIG. 9. Wall unit 970 includes a frame 972 and a system of panels 900. The frame 972 includes a plurality of openings 974 that receive the panels of system 900. Specifically, the openings 974 in frame 972 hold first panel 910, second panel 930, third panel 940, fourth panel 950 and various other panels.

In embodiments of the wall unit, the system of panels held in the frame can be configured according to any of the above embodiments. For example, the panels of system 500 are part of a wall unit 570 that includes frame 572. Likewise, the panels of system 600 are part of wall unit 670 that includes frame 672. While the panels of systems 500 that are styled as river rock and the panels of system 600 that are styled as brick are both shown as being disposed in a frame and being part of a wall unit, in certain embodiments panels of these styles are attached directly to the substrate wall without a frame.

Figure 11:
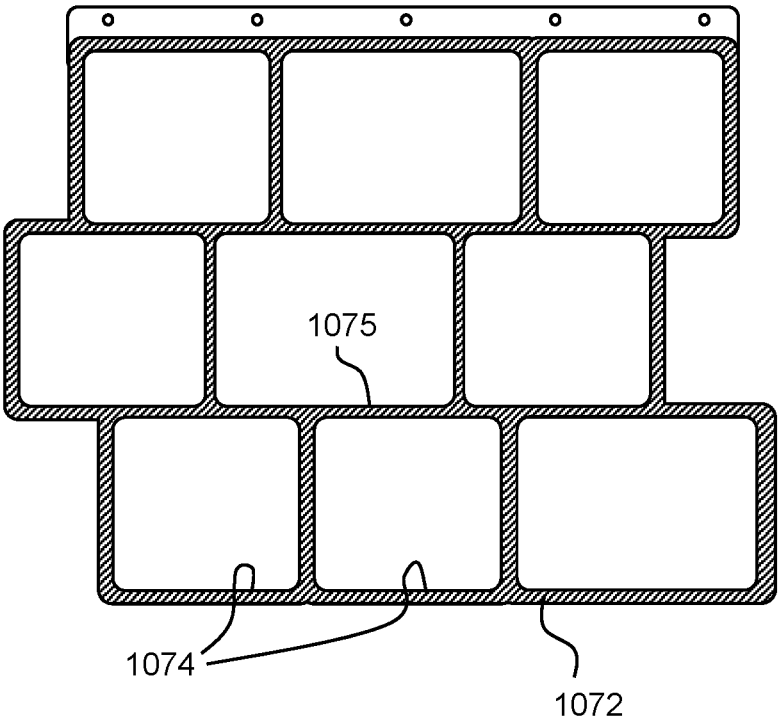
FIG. 11 is a schematic front view of a portion of the wall unit of FIG. 10.

In certain embodiments as otherwise described herein, each of the openings of the frame receives a single panel. For example, frame 972 of wall unit 970 includes nine openings and has nine panels respectively disposed in each of the openings. In other embodiments, at least one of the openings of the frame receives a single panel and at least one of the openings of the frame receives two panels. For example, wall unit 1070 includes frame 1072 that receives the panels of system 1000. As shown in FIG. 11, frame 1072 has nine openings 1074 with a configuration very similar to frame 972 of wall unit 970. However, there are two small panels

1060, 1062 received in the central opening 1075 of wall unit 1070. In certain embodiments, a small insert is included between any panels that are grouped in a single opening in the frame. For example, wall unit 1070 includes insert 1076 between panels 1060 and 1062.

Embodiments of the wall unit of the disclosure include various connections between the panels of the system and the frame. In certain embodiments as otherwise described herein, the support structure of each of the panels is welded to the frame. In some embodiments the panels are spot welded to the frame at select locations around the perimeter of the support structure. In other embodiments the entire seam around the perimeter of the panel is welded.

In certain embodiments as otherwise described herein, the support structure of each of the panels is attached to the frame with a mechanical fastener. For example, as will be appreciated by those of ordinary skill in the art, the support structure of each panel may include a small tab or fastening hem that is coupled to the frame with screws, staples or clips. Other mechanical fasteners are also possible.

In certain embodiments as otherwise described herein, the respective bodies of the panels are disposed at a distance from one another with a gap therebetween, and wherein the frame fills the gap between the bodies and is visible between the bodies. For example, the panels in wall unit 970 are positioned such that there is a gap between the respective visible bodies of the panels. As a result, a portion of the frame 972 is visible between the panels. For example, the visible bodies of first panel 910 and second panel 930 are separated by a gap such that a thin strip of frame 972 can be seen between the two panels. In some embodiments, the frame is constructed to have the appearance of grout between the panels. In particular the color of the frame is selected in certain embodiments to match popular grout color. In some embodiments the frame has a surface texture that mimics grout. In other embodiments the distance between the visible bodies of the panels and the thickness of the frame sections is such that frame is obscured from view and the wall unit appears as dry stacked stone.

In certain embodiments, the width of the frame varies between different panels held therein. For example, in some embodiments a portion of the frame between a first pair of the polymer panels in the wall unit has a first width and a portion of the frame between another pair of the polymer panels in the wall unit has a second width that is different from the first width. The difference in the width of portions of the frame also corresponds to differences in width of the gaps between the polymer panels. Such a variance in the width of the gaps between panels can help mask repetition in the wall units.

In certain embodiments as otherwise described herein, the wall unit includes a plurality of different panel types received therein, each of the panel types including a front face having a different textured contour. For example, first panel 910, second panel 930, and third panel 940 are each of different types and have a different textured contour on the front surface thereof.

In certain embodiments as otherwise described herein, the first panel is of a first panel type, and wherein the wall unit includes a fourth panel of the first panel type, and wherein the first and fourth panels are disposed at respective orientations that are 180 degrees from one another. For example, fourth panel 950 of wall unit 970 is of the same type as first panel 910 and thus, first panel 910 and fourth panel 950 have the same textured contour on the respective front faces thereof. However, fourth panel 950 is inserted into the respective opening in frame 972 in an orientation that is 180 degrees to that of first panel 910. In other embodiments, panels of the same type are attached to the frame in the same orientation, or at an angle that differs from 180 degrees. For example, panel 960 is of the same type as second panel 930 but and is disposed in the frame 972 with the same orientation as second panel 930. Further, in wall unit 570, fourth panel 550 is of the same type as first panel 510 and is disposed at an orientation of about 170 degrees from that of first panel 510. Other embodiments have panels of the same type that are disposed at varying angular orientations.

In some embodiments, the frame openings include labels to assist with the installation of proper panels into the corresponding openings of the frame. For example, one opening in the frame may be labeled with an (A) to indicate that the opening can receive any panel type under the category (A), where the category is based on the size of the panel. For instance, category (A) may relate to panels that are 6 inches by 8 inches. In another embodiment, the openings may include labels that show different alternatives. For example, the opening may be labelled "(A) or 2×(C)" to indicate that the opening may receive a single panel of category (A) or two panels of category (C), such as where panels under category (C) are 6 inches by 4 inches.

In certain embodiments as otherwise described herein, the wall unit includes panels of no more than 5 different sizes, e.g., no more than 4 different sizes, e.g., no more than 3 different sizes. As explained above with respect to the wall covering, the ability to place the individual panels in any configuration, to rotate the panels, and to vary the color of the panels makes it possible to create wall units that appear dissimilar, even when using frames having the same configuration of openings.

In certain embodiments as otherwise described herein, the wall unit further includes a fastening hem configured to secure the wall unit to a wall substrate. For example, wall unit 970 includes fastening hem 978 disposed at an upper edge of the wall unit. Fastening hem 978 allows the system of panels to be quickly installed on a substrate wall in groups.

Another aspect of the disclosure provides a method of fabricating wall units including providing the system according to the disclosure, providing a first frame including a plurality of openings, and inserting a group of panels into the openings in the first frame so as to form a first wall unit, where the group of panels includes the first, second, and third panels of the system.

Figure 12:
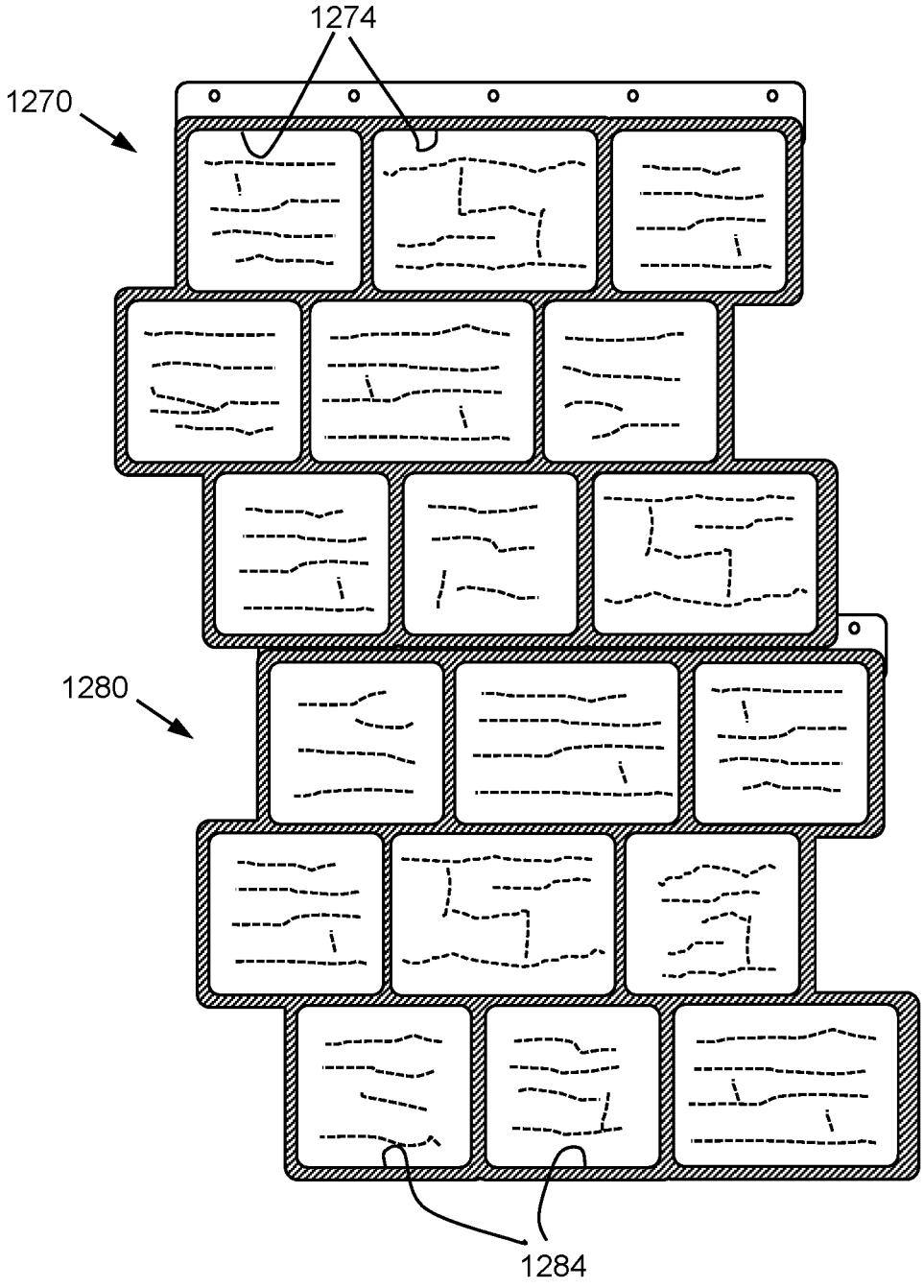
FIG. 12 is a schematic front view of two wall units according to another embodiment of the disclosure.

In certain embodiments as otherwise described herein, the method of fabricating wall units further includes providing a second frame including a plurality of openings and inserting additional panels of the system into the openings in the second frame so as to form a second wall unit. The shape of the first frame is the same as the shape of the second frame, the configuration of openings in the first frame is the same as the configuration of openings in the second frame, but the configuration of panels in the first frame is different from the configuration of panels in the second frame. For example, FIG. 12 shows a group of wall units including first wall unit 1270 and second wall unit 1280. The two wall units include frames having the same configuration of openings 1274, 1284. However, the configuration of the panels that are inserted into the frame openings differ. In other words, the layout of the textured contours of the panels in the first wall unit 1270 differs from the layout of textured contours of the second wall unit 1280. Accordingly, in a complete wall system, any slight repetition resulting from the similar opening configuration may be much less noticeable.

In some embodiments, the method of fabricating the wall units includes constructing the panels and the frame. As explained above, embodiments of the disclosure include fabricating the panels using a variety of different methods. In certain embodiments as otherwise described herein, the method includes injection molding the panels of the system. In other embodiments, the panels are roto molded, thermoformed, printed, or cast. In some embodiments the frame is likewise injection molded, roto molded, thermoformed, printed or cast.

Another aspect of the disclosure provides a method of installing a wall covering including providing a plurality of wall units according to the disclosure and attaching the wall units to a substrate wall.

In certain embodiments as otherwise described herein, each of the wall units includes a fastening hem, and wherein the attaching of the wall units includes fastening the wall units to the substrate wall using a mechanical fastener that penetrates the respective fastening hem. For example, a mechanical fastener, such as a screw, nail, staple or other fastener is inserted through the fastening hem to hold the wall unit against the substrate. In some embodiments, the fastening hem includes apertures for the insertion of the mechanical fastener. For example in some embodiments the fastening hem of the wall units includes screw holes.

In certain embodiments as otherwise described herein, the plurality of wall units includes: a first wall unit having a first frame and a group of panels disposed in openings in the first frame, the group of panels including the first, second, and third panels; and a second wall unit having a second frame including a plurality of openings and additional panels of the system disposed in openings in the second frame, wherein the shape of the first frame is the same as the shape of the second frame, wherein the configuration of openings in the first frame is the same as the configuration of openings in the second frame, and wherein the configuration of panels in the first frame is different from the configuration of panels in the second frame. For example, wall units 1270 and 1280 have the same configuration of openings 1274, 1284. Further, some of the same panel types are used in the first wall unit 1270 as in the second wall unit 1280. However, the configuration of the panels in the first wall unit 1270 differs from the configuration of panels in the second wall unit 1280. For example, the panel type in the upper left corner of the first wall unit 1270 is different from the panel type in the upper left corner of the second wall unit.

Additional aspects of the disclosure are provided by the following enumerated embodiments, which can be combined and permuted in any number and in any combination that is not technically or logically inconsistent.

Embodiment 1

A system for a wall covering having an appearance of a masonry wall, the system comprising:

a first polymer panel including a first visible body extending from a first support structure, the first visible body including a front surface that extends across a width of the first panel and has a first textured contour that replicates a single masonry unit;

a second polymer panel including a second visible body extending from a second support structure, the second visible body including a front surface that extends across a width of the second panel and has a second textured contour that replicates a single masonry unit; and a third polymer panel including a third visible body extending from a third support structure, the third visible body including a front surface that extends across a width of the third panel and has a third textured contour that replicates a single masonry unit;

wherein the first, second, and third textured contours are different, and wherein the size of the first panel is different from the size of the second panel.

Embodiment 2

The system according to embodiment 1, wherein a height of the first panel is different from a height of the second panel.

Embodiment 3

The system according to embodiment 1 or embodiment 2, wherein the width of the first panel is different from the width of the second panel.

Embodiment 4

The system according to any of embodiments 1 to 3, wherein the size of the third panel is different from the size of the first panel and the size of the second panel.

Embodiment 5

The system according to any of embodiments 1 to 4, wherein the first, second, and third textured contours replicate split stone masonry units.

Embodiment 6

The system according to any of embodiments 1 to 4, wherein the first, second, and third textured contours replicate smooth stone masonry units.

Embodiment 7

The system according to any of embodiments 1 to 4, wherein the first, second, and third textured contours replicate brick masonry units.

Embodiment 8

The system according to any of embodiments 1 to 7, wherein each of the first, second, and third textured contours has a contour depth range that is no more than 2 cm (0.79 in.), e.g., no more than 1 cm (0.39 in.), e.g., no more than 0.5 cm (0.20 in.).

Embodiment 9

The system according to any of embodiments 1 to 8, wherein each of the first, second, and third textured contours extend across at least 80% of the width of the respective panel, e.g., at least 90%, e.g., at least 95%.

Embodiment 10

The system according to any of embodiments 1 to 9, wherein each of the textured contours is free of any straight channels of more than 1 inch in length.

Embodiment 11

The system according to any of embodiments 1 to 10, wherein the support structure of each of the panels includes a fastening hem disposed on a first side of the panel and configured to hold the panels on a substrate.

Embodiment 12

The system according to embodiment 11, wherein the support structure of at least the first panel includes a second fastening hem disposed on a second side of the panel.

Embodiment 13

The system according to any of embodiments 1 to 12, wherein the visible body of each of the panels has a height in a range of 1 to 10 inches, e.g., 2 to 8 inches, e.g., 4 to 6 inches.

Embodiment 14

The system according to any of embodiments 1 to 13, wherein the visible body of each of the panels has a width in a range of 3 to 15 inches, e.g., 4 to 12 inches, e.g., 6 to 10 inches.

Embodiment 15

The system according to any of embodiments 1 to 14, wherein the visible body of each of the panels has a depth in a range of %2 inch to 4 inches, e.g., 1 to 3 inches, e.g., 2 to 3 inches.

Embodiment 16

The system according to any of embodiments 1 to 15, wherein each of the panels is formed of one or more of polypropylene, polyethylene, polyvinyl chloride (PVC), acrylonitrile styrene acrylate (ASA), polyurethane, or acrylonitrile butadiene styrene (ABS).

Embodiment 17

The system according to any of embodiments 1 to 16, wherein each of the panels includes a coating disposed over at least the front surface of the respective visible body.

Embodiment 18

The system according to any of embodiments 1 to 17, wherein each of the panels is injection molded.

Embodiment 19

The system according to any of embodiments 1 to 18, wherein each of the first, second, and third textured contours is a digitized rendering of a stone.

Embodiment 20

The system according to any of embodiments 1 to 19, wherein a color of the material of the first panel and a color of the material of the second panel have a color difference of at least 2 ΔE, e.g., at least 4 ΔE, e.g., at least 10 ΔE.

Embodiment 21

The system according to any of embodiments 1 to 20, wherein the support structure of each of the panels includes a tongue extending along a first edge and a receiving groove extending along a second edge that is opposite the first edge.

Embodiment 22

The system according to any of embodiments 1 to 21, further comprising a corner polymer panel including a visible body extending from an L-shaped support structure, the visible body including a dual-faceted surface that extends across a width and a breadth of the corner panel and has a textured contour that replicates two sides of a single masonry unit.

Embodiment 23

A polymer masonry wall covering comprising:

a wall substrate; and the system according to any of embodiments 1 to 22 attached to the wall substrate.

Embodiment 24

The polymer masonry wall covering according to embodiment 23, wherein the wall covering includes a plurality of different panel types attached to the wall substrate, each of the panel types including a front face having a different textured contour.

Embodiment 25

The polymer masonry wall covering according to embodiment 24, wherein the first panel is of a first panel type, and wherein the wall includes a fourth panel of the first panel type, and wherein the first and fourth panels are disposed at respective orientations that are 180 degrees from one another.

Embodiment 26

The polymer masonry wall covering according to embodiment 24 or embodiment 25, wherein the polymer masonry wall includes panel types of no more than 8 different sizes, e.g., no more than 6 different sizes, e.g., no more than 4 different sizes, e.g., no more than 3 different sizes.

Embodiment 27

The polymer masonry wall covering according to any of embodiments 24 to 26, wherein the polymer masonry wall includes no more than 8 different panel types of a particular size.

Embodiment 28

The polymer masonry wall covering according to any of embodiments 24 to 27, wherein the polymer masonry wall includes no more than 16 different panel types, e.g., no more than 10 different panel types, e.g., no more than 8 different panel types.

Embodiment 29

The polymer masonry wall covering according to any of embodiments 23 to 28, wherein each of the panels is attached to the wall substrate using a mechanical fastener.

Embodiment 30

The polymer masonry wall covering according any of embodiments 23 to 29, wherein each of the panels is attached to the wall substrate along an upper edge, but detached from the wall substrate along a lower edge.

Embodiment 31

A method of installing a polymer masonry wall covering according to any of embodiments 23 to 30, the method comprising:

providing a system according to any of embodiments 1 to 22;

providing a wall substrate; and attaching the panels of the system to the wall substrate.

Embodiment 32

The method according to embodiment 31, wherein each of the panels includes a fastening hem, and wherein the attaching the panels to the wall substrate includes fastening each of the panels to the wall substrate using a mechanical fastener that penetrates the fastening hem.

Embodiment 33

The method according to embodiment 31 or embodiment 32, wherein the attaching the panels includes fastening each of the panels along an upper edge, and leaving a lower edge of each of the panels detached from the wall substrate, and wherein the lower edge of a majority of the panels is held against the wall substrate by a neighboring panel.

Embodiment 34

The method according to any of embodiments 31 to 33, wherein the panels include a plurality of different panel types, each of the panel types including a front face having a different textured contour, wherein the first panel is of a first panel type, and wherein the attaching the panels to the wall substrate includes attaching a fourth panel, that is of the first panel type, to the wall substrate in an orientation that is 180 degrees from the orientation of the first panel.

Embodiment 35

A wall unit comprising:

a frame including a plurality of openings; and the system of any of embodiments 1 to 22, wherein a group of the panels of the system are received in the openings of the frame.

Embodiment 36

The wall unit according to embodiment 35, wherein each of the openings of the frame receives a single panel.

Embodiment 37

The wall unit according to embodiment 35, wherein at least one of the openings of the frame receives a single panel and at least one of the openings of the frame receives two panels.

Embodiment 38

The wall unit according to any of embodiments 35 to 37, wherein the support structure of each of the panels is welded to the frame.

Embodiment 39

The wall unit according to any of embodiments 35 to 37, wherein the support structure of each of the panels is attached to the frame with a mechanical fastener.

Embodiment 40

The wall unit according to any of embodiments 35 to 39, wherein the respective bodies of the panels are disposed at a distance from one another with a gap therebetween, and wherein the frame fills the gap between the bodies and is visible between the bodies.

Embodiment 41

The wall unit according to any of embodiments 35 to 40, wherein the wall unit includes a plurality of different panel types received therein, each of the panel types including a front face having a different textured contour.

Embodiment 42

The wall unit according to embodiment 41, wherein the first panel is of a first panel type, and wherein the wall unit includes a fourth panel of the first panel type, and wherein the first and fourth panels are disposed at respective orientations that are 180 degrees from one another.

Embodiment 43

The wall unit according to embodiment 41 or embodiment 42, wherein the wall unit includes panels of no more than 5 different sizes, e.g., no more than 4 different sizes, e.g., no more than 3 different sizes.

Embodiment 44

The wall unit according to any of embodiments 35 to 43, further comprising a fastening hem configured to secure the wall unit to a wall substrate.

Embodiment 45

A method of fabricating wall units according to any of embodiments 35 to 44, the method comprising:

providing the system according to any of embodiments 1 to 22;

providing a first frame including a plurality of openings;

inserting a group of panels into the openings in the first frame so as to form a first wall unit, the group of panels including the first, second, and third panels.

Embodiment 46

The method according to embodiment 45, further comprising:

providing a second frame including a plurality of openings;

inserting additional panels of the system into the openings in the second frame so as to form a second wall unit, wherein the shape of the first frame is the same as the shape of the second frame, wherein the configuration of openings in the first frame is the same as the configuration of openings in the second frame, and wherein the configuration of panels in the first frame is different from the configuration of panels in the second frame.

Embodiment 47

The method according to embodiment 45 or embodiment 46, further comprising injection molding the panels of the system.

Embodiment 48

A method of installing a wall covering according to any of embodiments 23 to 28, the method comprising:

providing a plurality of wall units according to any of embodiments 35 to 44; and attaching the wall units to a substrate wall.

Embodiment 49

The method according to embodiment 48, wherein each of the wall units includes a fastening hem, and wherein the attaching the wall units includes fastening the wall units to the substrate wall using a mechanical fastener that penetrates the respective fastening hem.

Embodiment 50

The method according to embodiment 48 or embodiment 49, wherein the plurality of wall units includes:

a first wall unit having a first frame and a group of panels disposed in openings in the first frame, the group of panels including the first, second, and third panels; and a second wall unit having a second frame including a plurality of openings and additional panels of the system disposed in openings in the second frame, wherein the shape of the first frame is the same as the shape of the second frame, wherein the configuration of openings in the first frame is the same as the configuration of openings in the second frame, and wherein the configuration of panels in the first frame is different from the configuration of panels in the second frame.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A polymer masonry wall covering comprising:

a wall substrate; and a system for a wall covering attached to the wall substrate, the system including a plurality of polymer panels comprising:

a first polymer panel including a first visible body extending from a first support structure, the first visible body including a front surface that extends across a width of the first panel and has a first textured contour that replicates a first single masonry unit, a second polymer panel including a second visible body extending from a second support structure, the second visible body including a front surface that extends across a width of the second panel and has a second textured contour that replicates a second single masonry unit, and a third polymer panel including a third visible body extending from a third support structure, the third visible body including a front surface that extends across a width of the third panel and has a third textured contour that replicates a third single masonry unit;

wherein the first, second, and third textured contours are different, wherein the size of the first panel is different from the size of the second panel, and wherein each of panels is attached to the wall substrate along an upper edge and detached from the wall substrate along a lower edge.

2. The polymer masonry wall covering according to claim 1, wherein the lower edge of a majority of the panels is held against the wall substrate by a neighboring panel.

3. The polymer masonry wall covering according to claim 1, wherein the wall covering includes a plurality of different panel types attached to the wall substrate, each of the panel types including a front face having a different textured contour, and wherein the first panel is of a first panel type, and wherein the wall includes a fourth panel of the first panel type, and wherein the first and fourth panels are disposed at respective orientations that are 180 degrees from one another.

4. A system for a wall covering having an appearance of a masonry wall, the system comprising:

a first polymer panel including a first visible body extending from a first support structure, the first visible body including a front surface that extends across a width of the first panel and has a first textured contour that replicates a first single masonry unit;

a second polymer panel including a second visible body extending from a second support structure, the second visible body including a front surface that extends across a width of the second panel and has a second textured contour that replicates a second single masonry unit; and a third polymer panel including a third visible body extending from a third support structure, the third visible body including a front surface that extends across a width of the third panel and has a third textured contour that replicates a third single masonry unit;

wherein the first, second, and third textured contours are different, wherein the size of the first panel is different from the size of the second panel, wherein each of the panels includes a coating disposed over at least the front surface of the respective visible body, and wherein at least a section of each coating is opaque.

5. The system according to claim 4, wherein a height of the first panel is different from a height of the second panel, wherein the width of the first panel is different from the width of the second panel, or wherein both the height and the width of the first panel is different from both the height and width of the second panel.

6. The system according to claim 4, wherein each of the panels is formed of one or more of polypropylene, polyethylene, polyvinyl chloride (PVC), acrylonitrile styrene acrylate (ASA), polyurethane, or acrylonitrile butadiene styrene (ABS).

7. The system according to claim 4, wherein a color of the material of the first panel and a color of the material of the second panel have a color difference of at least 2 ΔE.

8. The system according to claim 4, wherein the support structure of each of the panels includes a tongue extending along a first edge and a receiving groove extending along a second edge that is opposite the first edge.

9. The system according to claim 4, further comprising a corner polymer panel including a visible body extending from an L-shaped support structure, the visible body including a dual-faceted surface that extends across a width and a breadth of the corner panel and has a textured contour that replicates two sides of a single masonry unit.

10. The system according to claim 4, wherein the coating of each panel is variegated such that portions of the surface of the panel have different colors.

11. The system according to claim 4, wherein the coating of each panel includes transparent sections and opaque sections.

12. A method of installing a polymer masonry wall covering comprising a wall substrate and the system according to claim 4 attached to the wall substrate, the method comprising:

providing the system;

providing the wall substrate; and attaching the panels of the system to the wall substrate.

13. A wall unit comprising:

a frame including a plurality of openings; and a system comprising:

a first polymer panel including a first visible body extending from a first support structure, the first visible body including a front surface that extends across a width of the first panel and has a first textured contour that replicates a first single masonry unit;

a second polymer panel including a second visible body extending from a second support structure, the second visible body including a front surface that extends across a width of the second panel and has a second textured contour that replicates a second single masonry unit; and a third polymer panel including a third visible body extending from a third support structure, the third visible body including a front surface that extends across a width of the third panel and has a third textured contour that replicates a third single masonry unit;

wherein the first, second, and third textured contours are different, wherein the size of the first panel is different from the size of the second panel, and wherein a group of the panels of the system are received in the openings of the frame.

14. The wall unit according to claim 13, wherein each of the opening of the frame receives a single panel.

15. The wall unit according to claim 13, wherein at least one of the openings of the frame receives a single panel and at least one of the openings of the frame receives two panels.

16. The wall unit according to claim 13, wherein the wall unit includes a plurality of different panel types received in the openings of the frame, each of the panel types including a front face having a different textured contour.

17. The wall unit according to claim 16, wherein the first panel is of a first panel type, and wherein the wall unit includes a fourth panel of the first panel type.

18. The wall unit according to claim 17, wherein the fourth panel type is disposed at an orientation that is 180 degrees from an orientation of the first panel type.

19. A method of installing a polymer masonry wall covering including the wall unit according to claim 13, the method comprising:

providing the system;

providing a first frame including a plurality of openings;

inserting a group of panels into the openings in the first frame so as to form a first wall unit, the group of panels including the first, second, and third panels; and attaching the first wall unit to a wall substrate.

20. The method according to claim 19, further comprising:

providing a second frame including a plurality of openings;

inserting additional panels of the system into the openings in the second frame so as to form a second wall unit, and attaching the second wall unit to the wall substrate, wherein the shape of the first frame is the same as the shape of the second frame, wherein the configuration of openings in the first frame is the same as the configuration of openings in the second frame, and wherein the configuration of panels in the first frame is different from the configuration of panels in the second frame.

* * * * *